US010224000B2

(12) United States Patent
Hong et al.

(10) Patent No.: US 10,224,000 B2
(45) Date of Patent: Mar. 5, 2019

(54) VOLTAGE GENERATOR, DISPLAY DEVICE INCLUDING THE SAME AND VOLTAGE GENERATION METHOD

(71) Applicant: SAMSUNG DISPLAY CO., LTD., Yongin-si, Gyeonggi-do (KR)

(72) Inventors: Hyejung Hong, Cheonan-si (KR); Sanghyun Park, Cheonan-si (KR); Kyungmo Lee, Seoul (KR); Yong-Sik Hwang, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 292 days.

(21) Appl. No.: 15/201,285

(22) Filed: Jul. 1, 2016

(65) Prior Publication Data

US 2017/0148413 A1 May 25, 2017

(30) Foreign Application Priority Data

Nov. 20, 2015 (KR) ..... 10-2015-0163501

(51) Int. Cl.
*G09G 5/00* (2006.01)

(52) U.S. Cl.
CPC ..... *G09G 5/003* (2013.01); *G09G 2300/0426* (2013.01); *G09G 2310/0275* (2013.01); *G09G 2310/08* (2013.01); *G09G 2330/021* (2013.01)

(58) Field of Classification Search
CPC . G09G 5/00; G09G 3/10; G06F 3/038; G01R 27/26
See application file for complete search history.

(56) References Cited

U.S. PATENT DOCUMENTS

| | | | | |
|---|---|---|---|---|
| 8,533,508 | B2 | 9/2013 | Chang et al. | |
| 2008/0043008 | A1* | 2/2008 | Wang | H05B 33/0815 345/211 |
| 2009/0137282 | A1* | 5/2009 | Otaka | G09G 3/3406 455/566 |
| 2012/0242641 | A1* | 9/2012 | Lee | G09G 3/3655 345/212 |
| 2013/0229402 | A1* | 9/2013 | Park | G09G 3/32 345/212 |
| 2015/0348492 | A1* | 12/2015 | Park | G09G 3/3666 345/205 |

FOREIGN PATENT DOCUMENTS

| | | | |
|---|---|---|---|
| KR | 10-2011-0105698 | A | 9/2011 |
| KR | 10-2012-0109720 | A | 10/2012 |
| KR | 10-2014-0076252 | A | 6/2014 |
| KR | 10-2015-0086621 | A | 7/2015 |

* cited by examiner

*Primary Examiner* — Pegeman Karimi
(74) *Attorney, Agent, or Firm* — Lewis Roca Rothgerber Christie LLP

(57) ABSTRACT

A voltage generator includes: a transforming unit to transform an input voltage into an output voltage in response to a switching signal; a feedback voltage controller to compare the output voltage with a reference voltage when a start signal is activated, and to output a feedback voltage corresponding to the comparison of the output voltage with the reference voltage; and a power controller to compare the feedback voltage with the reference voltage, and to output the switching signal corresponding to the comparison of the feedback voltage with the reference voltage.

19 Claims, 5 Drawing Sheets

VOLTAGE GENERATOR, DISPLAY DEVICE INCLUDING THE SAME AND VOLTAGE GENERATION METHOD

CROSS-REFERENCE TO RELATED APPLICATION

This U.S. non-provisional patent application claims priority to and the benefit of Korean Patent Application No. 10-2015-0163501, under 35 U.S.C. § 119, filed on Nov. 20, 2015 in the Korean Intellectual Property Office (KIPO), the entire content of which is hereby incorporated by reference.

BACKGROUND

1. Field

One or more aspects of example embodiments of the present disclosure relate to a voltage generator, a display device including the same, and a voltage generation method.

2. Description of the Related Art

Typically, a display device includes a display panel for displaying an image and a driving circuit for driving the display panel. The display panel includes a plurality of gate lines, a plurality of data lines, and a plurality of pixels. Each of the plurality of pixels includes a thin film transistor, a liquid crystal capacitor, and a storage capacitor. The driving circuit includes a data driver (e.g., a source driver) for outputting data driving signals to data lines, a gate driver for outputting gate driving signals for driving gate lines, and a timing controller for controlling the data driver and the gate driver.

The display device may apply a gate-on voltage to a gate electrode of a thin film transistor connected to a corresponding gate line at a location desired to display an image, and may apply a data voltage corresponding to the display image to a source electrode of the thin film transistor to display the image.

As the size of the display panel becomes larger, a power consumption amount increases. Accordingly, technology has been proposed to lower an operation voltage level during a blank period between frames in which images are displayed. However, when the blank period becomes longer, a variation in operation voltage becomes larger, and thus, may influence a display image.

The above information disclosed in this Background section is for enhancement of understanding of the background of the inventive concept, and therefore, it may contain information that does not constitute prior art.

SUMMARY

One or more aspects of example embodiments of the present inventive concept are directed toward a voltage generator capable of reducing power consumption and preventing or reducing degradation of display quality.

One or more aspects of example embodiments of the present inventive concept are directed toward a display device including a voltage generator capable of reducing power consumption and preventing or reducing degradation of display quality.

One or more aspects of example embodiments of the present inventive concept are directed toward a voltage generation method capable of reducing power consumption and preventing or reducing degradation of display quality.

According to an example embodiment of the inventive concept, a voltage generator includes: a transforming unit configured to transform an input voltage into an output voltage in response to a switching signal; a feedback voltage controller configured to compare the output voltage with a reference voltage when a start signal is activated, and to output a feedback voltage corresponding to the comparison of the output voltage with the reference voltage; and a power controller configured to compare the feedback voltage with the reference voltage, and to output the switching signal corresponding to the comparison of the feedback voltage with the reference voltage.

In an embodiment, the feedback voltage controller may be configured to increase a level of the feedback voltage to a set voltage level to output the feedback voltage, when the start signal is activated and the output voltage has a lower level than that of the reference voltage.

In an embodiment, the feedback voltage controller may be configured to increase the feedback voltage to have a higher level than that of the reference voltage to output the feedback voltage, when the start signal is activated and the output voltage has a lower level than that of the reference voltage.

In an embodiment, the feedback voltage controller may be configured to output the output voltage as the feedback voltage, when the start signal is activated and the output voltage has a higher level than that of the reference voltage.

In an embodiment, the voltage generator may further include a reference voltage generator configured to generate the reference voltage.

In an embodiment, the power controller may be configured to output the switching signal having an ON level, when the start signal is activated.

In an embodiment, the transforming unit may include: a transformer configured to transform the input voltage into the output voltage; and a switch configured to operate the transformer in response to the switching signal.

In an embodiment, the switch may include a switching transistor comprising a first electrode connected to the transformer, a second electrode connected to a ground voltage, and a control electrode connected to a source of the switching signal.

According to an example embodiment of the inventive concept, a voltage generation method includes: transforming an input voltage into an output voltage in response to a switching signal having an ON level; receiving a start signal; comparing the output voltage with a reference voltage when the start signal is activated, and outputting a feedback voltage corresponding to the comparison of the output voltage with the reference voltage; comparing the feedback voltage with the reference voltage, and outputting the switching signal corresponding to the comparison of the feedback voltage with the reference voltage; and outputting the switching signal to have the ON level when the start signal is activated.

In an embodiment, the outputting of the feedback voltage may include increasing a level of the feedback voltage to a set level to output the feedback voltage, when the start signal is activated and the output voltage has a lower level than that of the reference voltage.

In an embodiment, the outputting of the feedback voltage may include increasing the feedback voltage to have a higher level than that of the reference voltage to output the feedback voltage, when the start signal is activated and the output voltage has a lower level than that of the reference voltage.

In an embodiment, the outputting of the feedback voltage may include outputting the output voltage as the feedback voltage, when the start signal is activated and the output voltage has a higher level than that of the reference voltage.

According to an example embodiment of the inventive concept, a display device includes: a display panel including a plurality of pixels respectively connected to a plurality of gate lines and a plurality of data lines; a gate driver configured to output gate signals to the plurality of gate lines; a data driver configured to drive the plurality of data lines; a timing controller configured to control the gate driver and the data driver, and to output a start signal; and a voltage generator configured to generate an output voltage that is utilized for operating at least one of the gate driver and the data driver, the voltage generator including: a transforming unit configured to transform an input voltage into an output voltage, when a switching signal has an ON level; a feedback voltage controller configured to compare the output voltage with a reference voltage when the start signal is activated, and to output a feedback voltage corresponding to the comparison of the output voltage with the reference voltage; and a power controller configured to compare the feedback voltage with the reference voltage, and to output the switching signal corresponding to the comparison of the feedback voltage with the reference voltage.

In an embodiment, the feedback voltage controller may be configured to increase a level of the feedback voltage to a set level to output the feedback voltage, when the start signal is activated and the output voltage has a lower level than that of the reference voltage.

In an embodiment, the feedback voltage controller may be configured to increase the feedback voltage to have a higher level than that of the reference voltage to output the feedback voltage, when the start signal is activated and the output voltage has a lower level than that of the reference voltage.

In an embodiment, the feedback voltage controller may be configured to output the output voltage as the feedback voltage, when the start signal is activated and the output voltage has a higher level than that of the reference voltage.

In an embodiment, the display device may further include a reference voltage generator configured to generate the reference voltage.

In an embodiment, the power controller may be configured to output the switching signal having the ON level, when the start signal is activated.

In an embodiment, the transforming unit may include: a transformer configured to transform the input voltage into the output voltage; and a switch configured to operate the transformer in response to the switching signal.

BRIEF DESCRIPTION OF THE DRAWINGS

The accompanying drawings are included to provide a further understanding of the inventive concept, and are incorporated in and constitute a part of this specification. The drawings illustrate exemplary embodiments of the inventive concept, and together with the detailed description, serve to explain the aspects and features of the inventive concept. In the drawings.

DETAILED DESCRIPTION

Figure 1:
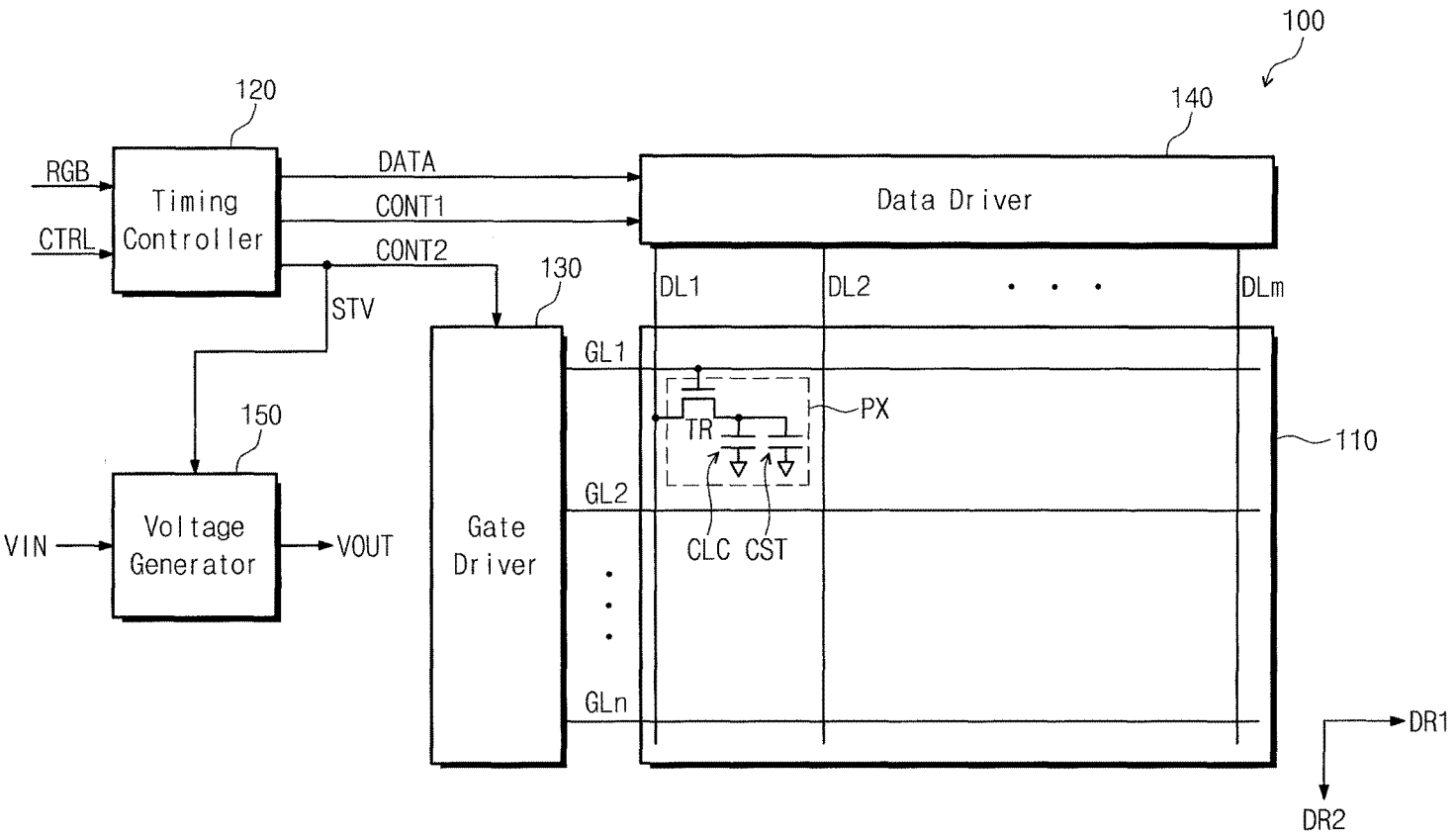
FIG. 1 is a block diagram illustrating a configuration of a display device according to an embodiment of the inventive concept.

Hereinafter, example embodiments will be described in more detail with reference to the accompanying drawings. The present inventive concept, however, may be embodied in various different forms, and should not be construed as being limited to only the illustrated embodiments herein. Rather, these embodiments are provided as examples so that this disclosure will be thorough and complete, and will fully convey the aspects and features of the inventive concept to those skilled in the art. Accordingly, processes, elements, and techniques that are not necessary to those having ordinary skill in the art for a complete understanding of the aspects and features of the inventive concept may not be described. Unless otherwise noted, like reference numerals denote like elements throughout the attached drawings and the written description, and thus, descriptions thereof may not be repeated.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the inventive concept.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the inventive concept refers to "one or more embodiments of the inventive concept." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating a configuration of a display device according to an embodiment of the inventive concept.

Referring to FIG. 1, a display device 100 includes a display panel 110 and a driving circuit. The driving circuit includes a timing controller 120, a gate driver 130, a data driver (e.g., a source driver) 140, and a voltage generator 150.

The display panel 110 includes a plurality of data lines DL1 to DLm, a plurality of gate lines GL1 to GLn crossing the plurality of data lines DL1 to DLm, and a plurality of pixels PX arranged (e.g., arrayed) at crossing regions of the plurality of data lines DL1 to DLm and the plurality of gate lines GL1 to GLn. The plurality of gate lines GL1 to GLn extend in a first direction DR1 from the gate driver 130, and are sequentially arranged with each other along a second direction DR2. The plurality of data lines DL1 to DLm extend in the second direction DR2 from the data driver 140, and are sequentially arranged with each other along the first direction DR1. The plurality of data lines DL1 to DLm are insulated from the plurality of gate lines GL1 to GLn.

Each of the plurality of pixels PX may include a switching transistor TR connected to a corresponding data line and a corresponding gate line, a liquid crystal capacitor CLC connected to the switching transistor TR, and a storage capacitor CST.

The timing controller 120 receives an image signal RGB and a control signal CTRL provided from the outside (e.g., exterior from the display device 100). The timing controller 120 provides a data signal DATA and a first control signal CONT1 to the data driver 140, and a second control signal CONT2 to the gate driver 130. The first control signal CONT1 may include a clock signal, a polarity control signal, and a load signal.

The data driver 140 drives the plurality of data lines DL1 to DLm in response to the data signal DATA and the first control signal CONT1 from the timing controller 120. The data driver 140 may be implemented as an independent integrated circuit to be electrically connected to one side of the display panel 110, or to be directly mounted on the display panel 110. In addition, the data driver 140 may be implemented as a single chip or may include a plurality of chips.

The gate driver 130 drives the plurality of gate lines GL1 to GLn in response to the second control signal CONT2 from the timing controller 120. The second control signal CONT2 may include a start signal STV and the clock signal. The gate driver 130 may be implemented as an independent integrated chip to be electrically connected to one side of the display panel 110. Furthermore, the gate driver 130 may be implemented as a circuit using an amorphous silicon gate (ASG) using an amorphous silicon thin film transistor (a-Si TFT), an oxide semiconductor, a crystalline semiconductor, or a polycrystalline semiconductor, and may be implemented at a region (e.g., a predetermined region) on the display panel 110. In another embodiment, the gate driver 130 may be implemented with a tape carrier package (TCP) or a chip on film (COF).

When a gate-on voltage is applied to a corresponding gate line, switching transistors TR in a row of pixels that are connected to the corresponding gate line may be turned on. At this point, the data driver 140 provides data driving signals corresponding to the data signal DATA to the data lines DL1 to DLm. The data driving signals provided to the data lines DL1 to DLm are applied to corresponding pixels through the turned-on switching transistors TR.

The voltage generator 150 converts an input voltage VIN into an output voltage VOUT. As described in more detail below, the output voltage VOUT output from the voltage generator 150 may be a gate-on voltage VON, which is used for an operation of the gate driver 130. The output voltage VOUT may be one of an analog power supply voltage used for an operation of the data driver 140, a common voltage to be provided to the display panel 110, and/or various voltages used for an operation of the display device 100.

Figure 2:
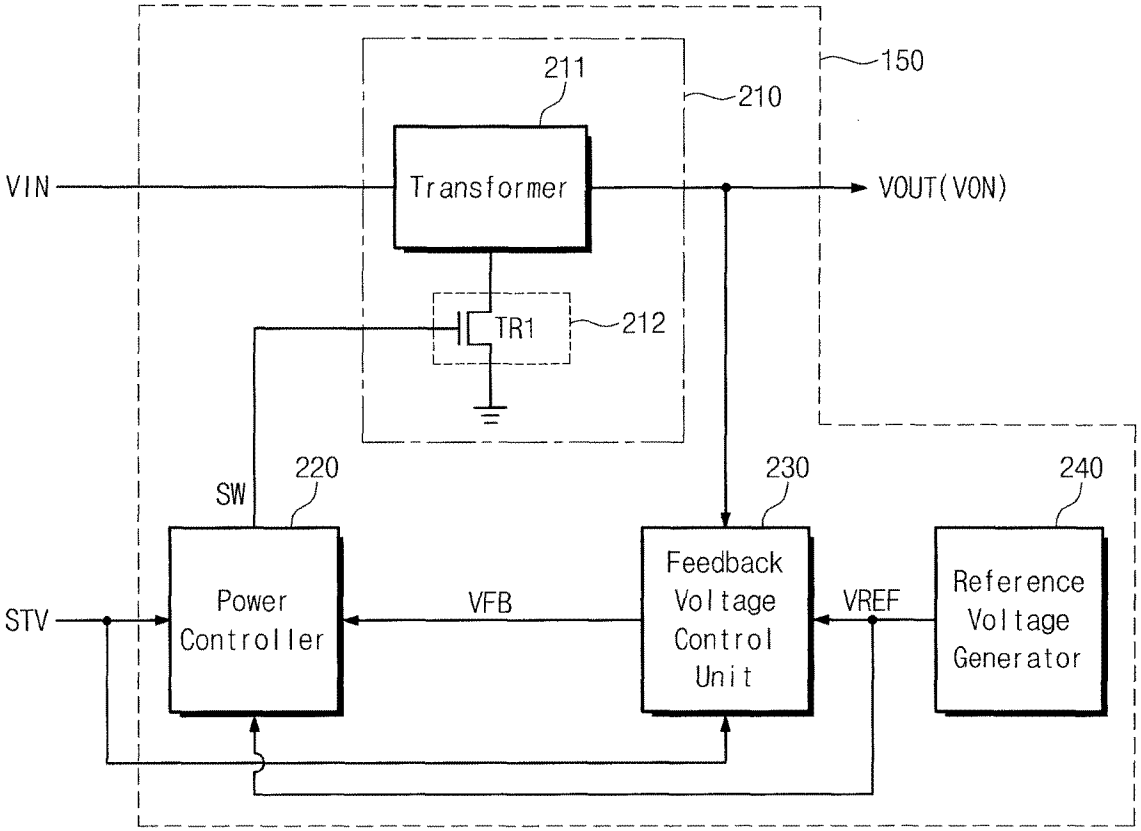
FIG. 2 illustrates an exemplary configuration of the voltage generator illustrated in FIG. 1.

FIG. 2 illustrates an exemplary configuration of the voltage generator illustrated in FIG. 1.

Referring to FIG. 2, the voltage generator 150 includes a transforming unit 210, a power controller 220, a feedback voltage control unit (e.g., a feedback voltage controller) 230, and a reference voltage generator 240. The transforming unit 210 includes a transformer 211 and a switching unit (e.g., a switch) 212. The transformer 211 converts the input voltage VIN into an output voltage VOUT. The switching unit 212 controls an operation of the transformer 211 in response to a switching signal SW. The switching unit 212 includes a switching transistor TR1 including a first electrode connected to the transformer 211, a second electrode connected to a voltage (e.g., a ground voltage), and a control electrode connected to the switching signal SW. The transformer 211 may convert the input voltage VIN to the output voltage VOUT to output the output voltage VOUT in response to turn on/off operation of the switching transistor TR1.

The reference voltage generator 240 generates a reference voltage VREF. The feedback voltage control unit 230 compares the output voltage VOUT with the reference voltage VREF, and outputs a feedback voltage VFB corresponding to the comparison result. When the start signal STV supplied from the timing controller 120 (e.g., see FIG. 1) is activated, and the output voltage VOUT has a lower level than that of the reference voltage VREF, the feedback voltage control unit 230 increases the feedback voltage VFB to a voltage level (e.g., a predetermined voltage level) to output the feedback voltage VFB. When the start signal STV is activated and the output voltage VOUT has a level that is greater than or equal to that of the reference voltage VREF, the feedback voltage control unit 230 outputs the output voltage VOUT as the feedback voltage VFB.

The power controller 220 outputs the switching signal SW according to a voltage level of the feedback voltage VFB. For example, when the feedback voltage VFB has a lower level than that of an internal reference voltage, the switching signal SW having an active level (e.g., a high level or an ON level) is output to increase a voltage level of the output voltage VOUT. When the switching signal SW has the active level (e.g. the high level or the ON level), the switching transistor TR1 is turned on and the transformer 211 may perform a voltage transforming operation. When the voltage level of the feedback voltage VFB is higher than that of the internal reference voltage, the power controller 220 may output the switching signal SW having an inactive level (e.g., a low level or an OFF level) to control the transformer 211 to not operate.

In addition, when the feedback voltage VFB has a lower level than that of the reference voltage VREF, the power controller 220 enters a pulse skip mode (PSM) to output the switching signal SW having the inactive level. The transformer 211 may not operate during the PSM to reduce power consumption in a blank period. When the start signal STV is activated, the power controller 220 terminates the PSM and outputs the switching signal SW having the active level.

Figure 3:
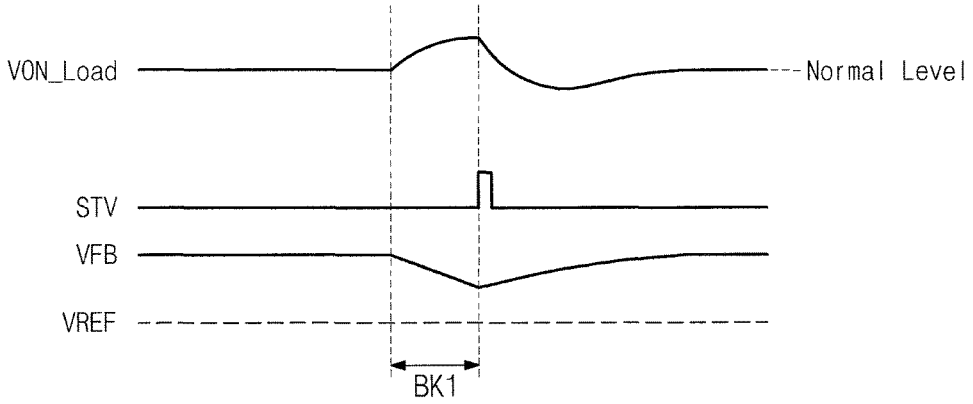
FIGS. 3 and 4 are timing diagrams illustrating exemplary voltage level changes of a feedback voltage during a blank period.
Figure 4:
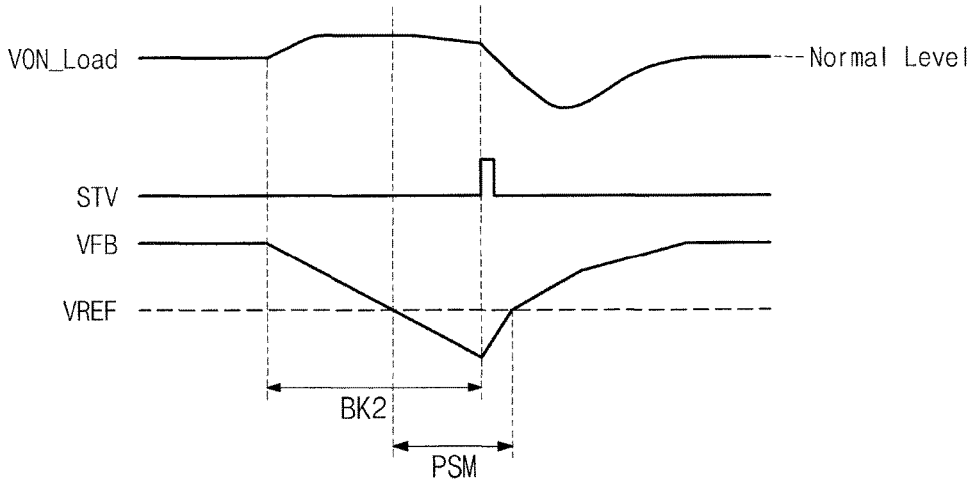

FIGS. 3 and 4 are timing diagrams illustrating exemplary voltage level changes of a feedback voltage during a blank period. In the examples illustrated in FIGS. 3 and 4, it is assumed that the feedback voltage control unit 230 of FIG. 2 delivers the output voltage VOUT as the feedback voltage VFB without a change.

Referring to FIGS. 2 and 3, a blank period BK1 is a period after an n-th gate line GLn of a K-th frame (where K is a positive integer) is driven until a first gate line GL1 of a (K+1)-th frame is driven. When the blank period BK1 starts, the gate driver 130 illustrated in FIG. 1 does not operate. Although the output voltage VOUT (e.g., the gate-on voltage VON) output from the voltage generator 150 is maintained or substantially maintained at a certain level, because there is not a load during the blank period BK1, a voltage level of the gate-on voltage VON_Load received by the gate driver 130 increases.

As the voltage level of the gate-on voltage VON_Load increases, the power controller 220 outputs the switching signal SW having the OFF level to lower the voltage level of the gate-on voltage VON_Load. When the start signal STV is activated, the power controller 220 outputs the switching signal SW having the ON level.

Referring to FIGS. 2 and 4, when the voltage level of the gate-on voltage VON_Load increases after a blank period BK2 starts, the power controller 220 outputs the switching signal SW having the OFF level to lower the voltage level of the gate-on voltage VON_Load. As the voltage level of the gate-on voltage VON_Load is lowered, the voltage level of the feedback voltage VFB is also lowered. When the voltage level of the feedback voltage VFB becomes lower than that of the reference voltage VREF, the power controller 220 operates in the PSM. During the PSM, because the power controller 220 outputs the switching signal SW having the OFF level, the voltage level of the feedback voltage VFB becomes further lowered. When the start signal STV is activated, the power controller 220 outputs the switching signal SW having the ON level. Even after the start signal STV is activated, because the feedback voltage VFB still has a lower level than that of the reference level VREF and because the PSM is maintained, it may take a long time to stabilize the output voltage VOUT, namely, the gate-on voltage VON_Load.

As illustrated in FIG. 3, when the blank period BK1 is short, the gate-on voltage VON_Load may rapidly return to a normal level, but as illustrated in FIG. 4, when the blank period BK2 is long, it takes a relatively longer time for the gate-on voltage VON_Load to return to the normal level.

When the first gate line GL1 of the (K+1)-th frame is driven and the voltage level of the gate-on voltage VON_Load is lower than the normal level, a top portion of an image on the display panel 110 illustrated in FIG. 1 may be distorted.

Figure 5:
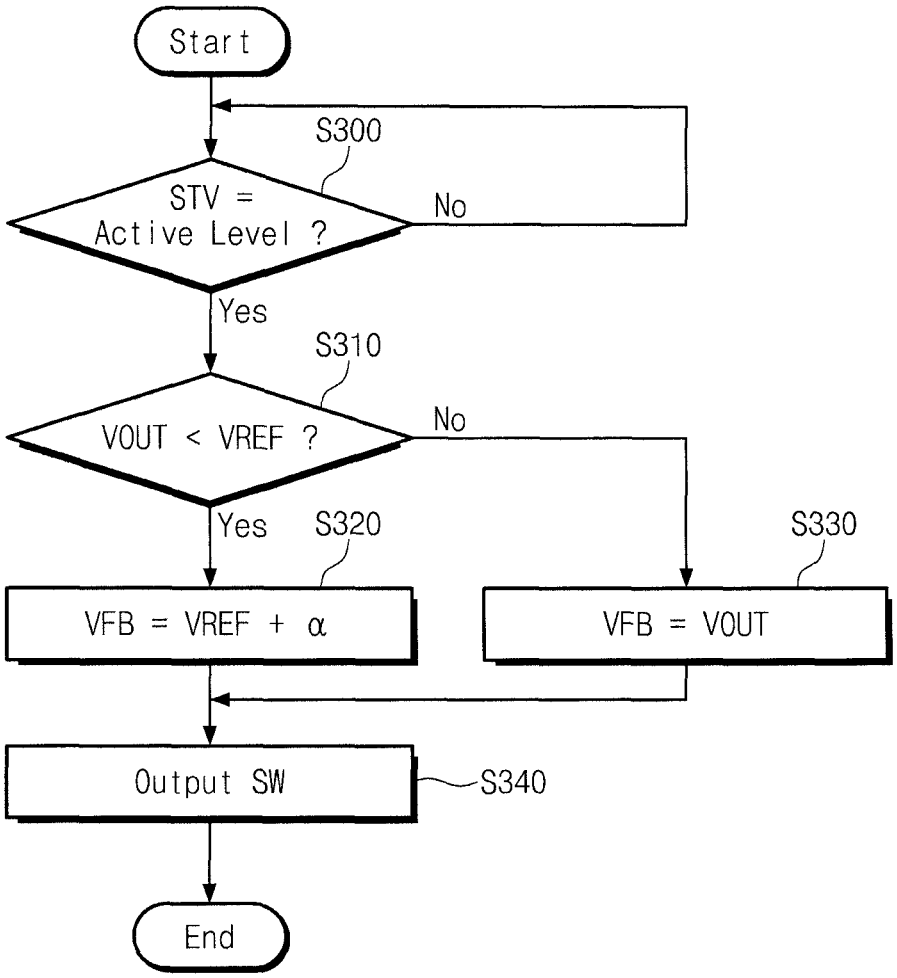
FIG. 5 is a flowchart illustrating an exemplary operation of the voltage generator illustrated in FIG. 2.

FIG. 5 is a flowchart illustrating an exemplary operation of the voltage generator illustrated in FIG. 2.

Referring to FIGS. 2 and 5, the transforming unit 210 converts an input voltage VIN into an output voltage VOUT. The feedback voltage control unit 230 receives a start signal STV from the timing controller 120 illustrated in FIG. 1. The feedback voltage control unit 230 determines whether the start signal STV is activated (operation S300). When the start signal STV is activated, it is determined whether the output voltage VOUT has a lower level than that of the reference voltage VREF (operation S310). When the output voltage VOUT has a lower level than that of the reference voltage VREF, the feedback voltage VFB is set to have a voltage level higher than that of the reference voltage VREF by a level (e.g., a predetermined level) $\alpha$(operation S320). When the output voltage VOUT is greater than or equal to the reference voltage VREF, the output voltage VOUT is output as the feedback voltage VFB (operation S330).

The power controller 220 outputs the switching signal SW (operation S340). When the output voltage VOUT has a higher level than the reference voltage VREF, the power controller 220 outputs the switching signal SW having the ON level (e.g., the high level).

Figure 6:
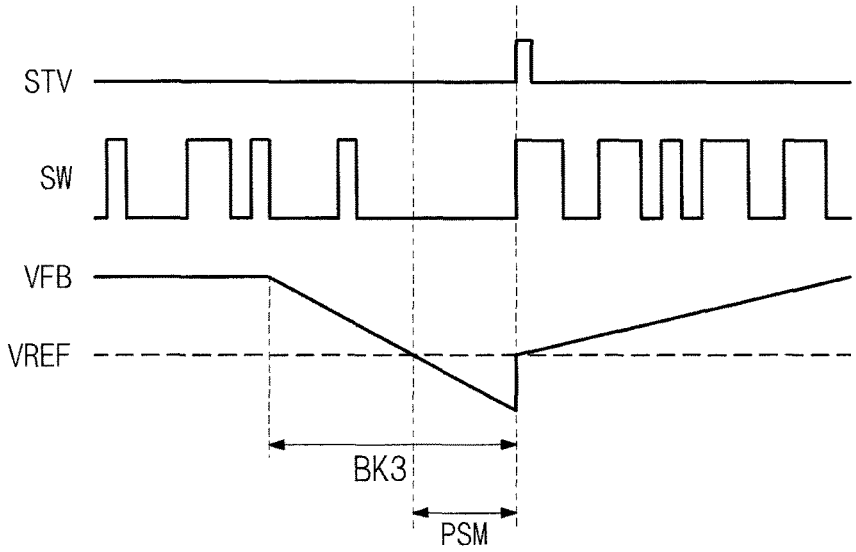
FIG. 6 is a timing diagram illustrating an exemplary voltage level change of a feedback voltage during a blank period in a voltage generator according to an embodiment of the inventive concept.

FIG. 6 is a timing diagram illustrating an exemplary voltage level change of a feedback voltage during a blank period in a voltage generator according to an embodiment of the inventive concept.

Referring to FIGS. 2 and 6, during a period where the start signal STV is not activated, the feedback voltage control unit 230 outputs the output voltage VOUT as the feedback voltage VFB. A period, after an n-th gate line GLn of the K-th frame (where K is a positive integer) is driven until a first gate line GL1 of the (K+1)-th frame is driven, is referred to as a blank period BK3. When the blank period BK3 starts, since the voltage level of the output voltage VOUT becomes lowered, the voltage level of the feedback voltage VFB becomes lowered.

When the voltage level of the feedback voltage VFB becomes lower than the reference voltage VREF, the power controller 220 operates in the PSM. During the PSM, the power controller 220 may output the switching signal SW having an OFF level to minimize or reduce power consumption of the voltage generator 150.

When the start signal STV is activated, the feedback voltage control unit 230 outputs the feedback voltage VFB having a level of the reference voltage VREF, or a level of VREF+α, which is higher than the level of the reference voltage VREF by a level (e.g., a predetermined level) α.

When the start signal STV is activated, the power controller 220 outputs the switching signal SW having an ON level. In addition, because the feedback voltage VFB is higher than the reference voltage VREF, the power controller 220 terminates (or ends) the PSM. After the start signal STV is activated, since the power controller 220 maintains or substantially maintains the switching signal SW to have the ON level, a time taken for the voltage level of the output voltage VOUT to return to a normal level may be shortened. After the start signal STV is activated, since the output voltage VOUT is rapidly stabilized, a stable operation of the gate driver 130 illustrated in FIG. 1 may be ensured. Therefore, quality of an image displayed on the display panel 110 may be improved.

Figure 7:
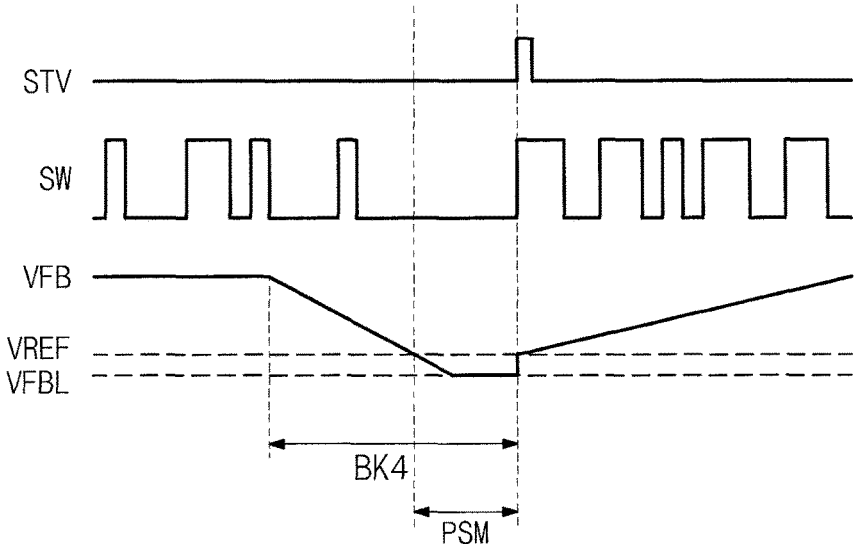
FIG. 7 is a timing diagram illustrating another exemplary voltage level change of a feedback voltage during a blank period in a voltage generator according to an embodiment of the inventive concept.

FIG. 7 is a timing diagram illustrating another exemplary voltage level change of a feedback voltage during a blank period in a voltage generator according to an embodiment of the inventive concept.

Referring to FIGS. 2 and 7, during a period where the start signal STV is not activated, the feedback voltage control unit 230 outputs the output voltage VOUT as the feedback voltage VFB. When a blank period BK4 starts, since the voltage level of the output voltage VOUT becomes lowered, the voltage level of the feedback voltage VFB also becomes lowered.

When the feedback voltage VFB has a lower voltage level than that of the reference voltage VREF, the feedback voltage control unit 230 outputs the feedback voltage VFB to not be further lowered than a set or predetermined voltage level VFBL.

When the voltage level of the feedback voltage VFB becomes lower than the reference voltage VREF, the power controller 220 operates in the PSM. During the PSM, the power controller 220 may output the switching signal SW having an OFF level to minimize or reduce power consumption of the voltage generator 150.

When the start signal STV is activated, the feedback voltage control unit 230 outputs the VFB having a level of the reference voltage VREF, or a level of VREF+α, which is higher than the level of the reference voltage VREF by a level (e.g., a predetermined level) α. Because the feedback voltage VFB is maintained or substantially maintained as the set or predetermined voltage level VFBL during a portion of the blank period BK4, when the start signal STV is activated, a time taken for the feedback voltage control unit 230 to increase the feedback voltage VFB to the level of the reference voltage VREF or to the level of VREF+α, which is higher than the level of the reference voltage VREF by the level α, may be further shortened.

The voltage generator 150 may generate an analog power source voltage used for the operation of the data driver 140, a common voltage to be provided to the display panel 110, and/or at least one of various voltages used for the display device 100 as well as the gate-on voltage VON. Further, when the display device 100 includes a backlight unit (e.g., a backlight source), the voltage generator 150 may generate a voltage used for an operation of the backlight unit.

A voltage generator including such a configuration may increase a level of a feedback voltage to a desired or predetermined level, when an output voltage is lower than a reference voltage at the time of returning from a standby mode to a normal mode. Accordingly, when returning from the standby mode to the normal mode, the output voltage may rapidly return to a normal level. Thus, display quality of an image displayed on a display panel may be prevented or substantially prevented from being degraded.

The electronic or electric devices and/or any other relevant devices or components according to embodiments of the inventive concept described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the inventive concept.

Although exemplary embodiments of the present invention have been described, it is understood that the present invention should not be limited to these exemplary embodiments, but that various changes and modifications may be made by one having ordinary skill in the art within the spirit and scope of the present invention as defined in the following claims and their equivalents.

What is claimed is:

1. A voltage generator comprising:

a transforming unit configured to transform an input voltage into an output voltage in response to a switching signal;

a feedback voltage controller configured to compare the output voltage with a reference voltage when a start signal is activated, and to output a feedback voltage corresponding to the comparison of the output voltage with the reference voltage; and a power controller configured to compare the feedback voltage with the reference voltage, and to output the switching signal corresponding to the comparison of the feedback voltage with the reference voltage.

2. The voltage generator of claim 1, wherein the feedback voltage controller is configured to increase a level of the feedback voltage to a set voltage level to output the feedback voltage, when the start signal is activated and the output voltage has a lower level than that of the reference voltage.

3. The voltage generator of claim 1, wherein the feedback voltage controller is configured to increase the feedback voltage to have a higher level than that of the reference voltage to output the feedback voltage, when the start signal is activated and the output voltage has a lower level than that of the reference voltage.

4. The voltage generator of claim 1, wherein the feedback voltage controller is configured to output the output voltage as the feedback voltage, when the start signal is activated and the output voltage has a higher level than that of the reference voltage.

5. The voltage generator of claim 1, further comprising a reference voltage generator configured to generate the reference voltage.

6. The voltage generator of claim 1, wherein the power controller is configured to output the switching signal having an ON level, when the start signal is activated.

7. The voltage generator of claim 6, wherein the transforming unit comprises:

a transformor configured to transform input voltage Into the output voltage; and a switch configured to operate the transformer in response to the switching signal.

8. The voltage generator of claim 7, wherein the switch comprises a switching transistor comprising a first electrode connected to the transformer, a second electrode connected to a ground voltage, and a control electrode connected to a source of the switching signal.

9. A voltage generation method comprising:

transforming an input voltage into an output voltage in response to a switching signal having an ON level;

receiving a start signal;

comparing the output voltage with a reference voltage when the start signal is activated, and outputting a feedback voltage corresponding to the comparison of the output voltage with the reference voltage;

comparing the feedback voltage with the reference voltage, and outputting the switching signal corresponding to the comparison of the feedback voltage with the reference voltage; and outputting the switching signal to have the ON level when the start signal is activated.

10. The voltage generation method of claim 9, wherein the outputting of the feedback voltage comprises increasing a level of the feedback voltage to a set level to output the feedback voltage, when the start signal is activated and the output voltage has a lower level than that of the reference voltage.

11. The voltage generation method of claim 10, wherein the outputting of the feedback voltage comprises increasing the feedback voltage to have a higher level than that of the reference voltage to output the feedback voltage, when the start signal is activated and the output voltage has a lower level than that of the reference voltage.

12. The voltage generation method of claim 11, wherein the outputting of the feedback voltage comprises outputting the output voltage as the feedback voltage, when the start signal is activated and the output voltage has a higher level than that of the reference voltage.

13. A display device comprising:

a display panel comprising a plurality of pixels respectively connected to a plurality of gate lines and a plurality of data lines;

a gate driver configured to output gate signals to the plurality of gate lines;

a data driver configured to drive the plurality of data lines;

a timing controller configured to control the gate driver and the data driver, and to output a start signal; and a voltage generator configured to generate an output voltage that is utilized for operating at least one of the gate driver and the data driver, the voltage generator comprising:

a transforming unit configured to transform an input voltage into an output voltage, when a switching signal has an ON level;

a feedback voltage controller configured to compare the output voltage with a reference voltage when the start signal is activated, and to output a feedback voltage corresponding to the comparison of the output voltage with the reference voltage; and a power controller configured to compare the feedback voltage with the reference voltage, and to output the switching signal corresponding to the comparison of the feedback voltage with the reference voltage.

14. The display device of claim 13, wherein the feedback voltage controller is configured to increase a level of the feedback voltage to a set level to output the feedback voltage, when the start signal is activated and the output voltage has a lower level than that of the reference voltage.

15. The display device of claim 13, wherein the feedback voltage controller is configured to increase the feedback voltage to have a higher level than that of the reference voltage to output the feedback voltage, when the start signal is activated and the output voltage has a lower level than that of the reference voltage.

16. The display device of claim 13, wherein the feedback voltage controller is configured to output the output voltage as the feedback voltage, when the start signal is activated and the output voltage has a higher level than that of the reference voltage.

17. The display device of claim 13, further comprising a reference voltage generator configured to generate the reference voltage.

18. The display device of claim 13, wherein the power controller is configured to output the switching signal having the ON level, when the start signal is activated.

19. The display device of claim 13, wherein the transforming unit comprises:

a transformer configured to transform the input voltage into the output voltage; and a switch configured to operate the transformer in response to the switching signal.

* * * * *